US005970550A

United States Patent [19]

Gazes

[11] Patent Number: 5,970,550

[45] Date of Patent: Oct. 26, 1999

[54] MULTIPLE COMPARTMENT INFLATABLE MATTRESS

[76] Inventor: Jimmy Gazes, 803 O'Sullivan Dr., Mt. Pleasant, S.C. 29464

[21] Appl. No.: 08/841,171

[22] Filed: Apr. 29, 1997

Related U.S. Application Data

[60] Provisional application No. 60/016,455, Apr. 29, 1996.

[51] Int. Cl.[6] ..... A61G 7/057; A47C 27/10; A47C 21/04

[52] U.S. Cl. ..... 5/715; 5/710; 5/713; 5/421; 5/423

[58] Field of Search ..... 5/706, 710, 713, 5/715, 731, 740, 953, 609, 615, 633, 655.9, 421, 423, 284

[56] References Cited

U.S. PATENT DOCUMENTS

| | | | |
|---|---|---|---|
| 2,493,067 | 1/1950 | Goldsmith | 5/423 |
| 3,477,071 | 11/1969 | Emerson | 5/715 X |
| 3,775,781 | 12/1973 | Bruno et al. | 5/715 X |
| 3,909,858 | 10/1975 | Ducker | 5/713 |
| 4,175,297 | 11/1979 | Robbins et al. | 5/284 |
| 4,617,690 | 10/1986 | Grebe | 5/713 |
| 4,635,306 | 1/1987 | Willey | 5/633 |
| 4,907,308 | 3/1990 | Leininger et al. | 5/421 X |
| 4,944,060 | 7/1990 | Peery et al. | 5/713 |
| 5,121,512 | 6/1992 | Kaufmann | 5/713 |
| 5,142,719 | 9/1992 | Vrzalik | 5/715 X |
| 5,142,720 | 9/1992 | Kelso et al. | 5/715 X |
| 5,249,318 | 10/1993 | Loadsman | 5/423 X |
| 5,251,349 | 10/1993 | Thomas et al. | 5/715 X |
| 5,335,381 | 8/1994 | Chang | 5/423 |
| 5,416,935 | 5/1995 | Nieh | 5/284 |
| 5,528,783 | 6/1996 | Kunz et al. | 5/615 |
| 5,642,539 | 7/1997 | Kuo | 5/423 |
| 5,774,917 | 7/1998 | Liu | 5/715 |

FOREIGN PATENT DOCUMENTS

| | | | |
|---|---|---|---|
| 678268 | 8/1991 | Switzerland | 5/615 |

*Primary Examiner*—Michael F. Trettel
*Assistant Examiner*—Robert G. Santos
*Attorney, Agent, or Firm*—B. Craig Killough

[57] ABSTRACT

An inflatable mattress having multiple compartments which may be selectively inflated and deflated to produce variable contact of the mattress with the occupant's body. Some of the compartments may be active, and others inactive, with the active compartments of the mattress controlled by automatic controls to cyclically inflate and deflate the compartments. The device may be operated manually to allow the operator to deflate the necessary compartments for placement of a bedpan, or other access to the occupant. Multiple foam rubber wedges are inserted into deflated compartments, then inflated to turn the occupant on his or her side. Various embodiments are inflated by air, nitrogen or water. A water-to-air heat pump, or an air-to-air heat pump may be used to control the temperature.

10 Claims, 4 Drawing Sheets

TURNING WEDGE

BODY LIFTING WEDGE

AIR TIGHT FLANGE
WITH COPPER TUBE

TURNING WEDGE

BODY LIFTING WEDGE

LEG LIFTING WEDGE

MULTIPLE COMPARTMENT INFLATABLE MATTRESS

This application is a provisional of 60/016,455 filed Apr. 29, 1996.

FIELD OF THE INVENTION

This invention relates to hospital and convalescent beds in general, and is specifically directed to an inflatable mattress that is controlled to relieve pressure in a progressive manner on the occupant's body.

BACKGROUND OF THE INVENTION

The inflated mattress of the present invention has multiple inflatable compartments, some of which are inactive and some of which are active. When a portion of the active compartments are deflated, the remaining compartments are inflated.

In beds now in use in hospitals and other care units, movement of the patient from contact with the bed is performed by two or more people. A patient that needs a bedpan must usually be served by two or more people, in order to place the bedpan in position.

Pressure sores or bed sores are commonly associated with inactive patients. It has been shown that movement of the occupant relative to the bed can alleviate this problem.

Another complication associated with inactivity is the collection of fluids in the lungs. Movement of the patient at regular intervals is imperative to prevent this problem. This movement is a difficult manual job for two or more people, and further, such movement and manipulation places the occupant at risk, particularly if the patient is feeble, or in an intensive care situation.

Washing, lubricating and medicating the patient's body is very difficult if the patient is not physically able to cooperate. This process can be agonizing for the patient and difficult for the two or more people needed to perform the operation. This process is time consuming, and requires substantial labor, and introduces increased risk of harm to the patient.

SUMMARY OF THE INVENTION

The present invention is a mattress having multiple inflatable sections. The multiple inflatable sections are controlled to eliminate constant contact of the mattress with the occupant's body, and to provide a mechanized means of movement of the occupant relative to the mattress for the performance of certain functions.

The mattress of the present invention alternates, by means of inflatable sections of the mattress, contact and pressure with the patient's body for a given period of time. Complications associated with pressure sores and other ailments which result from constant contact of one part of the mattress with the body are thereby eliminated. When the device is operating automatically, no adjoining compartments are deflated, and the size of the opening or void that the occupant's body bridges is controlled.

In the manual mode, inflation and deflation of the compartments is controlled according to the specific needs of the patient. An electrical box with relays and a panel that contains numbered switches allows an operator, by actuation of one or more switches, to expose the part of the body to be treated.

When the patient needs a bedpan, the operator selects a compartment or compartments so that a bedpan can be placed in the desired position. The manual operation of this system allows a nurse or aide to give enemas, or to wash, medicate or lubricate any portion of the patient's body, usually without assistance.

Multiple wedges are used to turn the patient. The operator can deflate the compartments one or two at a time, and place a wedge in the space which results from deflation. When the compartment is inflated, it lifts the wedge, and begins to turn the patient. To turn the patient to the opposite side, the wedges are placed in the space on the opposite side of the bed. Then, in a progressive manner, the patient is turned to a comfortable position.

Another embodiment of the device is inflated with air by an air compressor that is controlled by a pressure switch. If the pressure drops below a predetermined level, the air compressor supplies air as required, and is then switched off.

The device may use nitrogen as an inflation gas, with inflation monitored by a pressure regulator attached to an outlet of a nitrogen bottle. This embodiment incorporates manually operated valves to control the inflation and deflation of the compartments to meet the objects of the invention.

Another embodiment of the invention uses a water-to-air heat pump that heats or cools the water. It is primarily intended for emergency or intensive care use, but can be used for other applications. Quick connect water attachments enable the heat pump to be connected quickly to the mattress. This embodiment can be plugged into any wall receptacle and is thermostatically controlled from 35° F. to 120° F.

When a patient exhibits symptoms of hyperthermia, cold blankets are used to lower the fever. If the patient exhibits symptoms of hypothermia, warm or hot blankets are used to raise the temperature. These treatments require labor and monitoring over long periods of time. With the present invention, any blanket can be placed over the patient and the desired temperature may be controlled by thermostatic means. The temperature controlled water in the mattress allows the central air conditioning system to be set as much as 15° F. warmer in the summer and as much as 15° F. cooler in the winter, without affecting the occupant's comfort.

In one embodiment, the present invention incorporates an inflatable air filled mattress that is divided into individual compartments and can be used on any hospital bed. It replaces the conventional mattress and allows selected portions of the patient's body to be exposed for treatment. Associated labor cost reductions are achieved that are very important in today's health care market.

A preferred embodiment of the invention has nine compartments, two of which are on each end and are not selectively inflatable and deflatable, and five that are selectively inflatable and deflatable, or "active". When one of the active compartments is deflated, the remaining four are inflated.

The inflation and deflation of the active compartments is time controlled. Each of the active compartments is deflated one at a time to remove pressure and contact with the patient's body.

The device removes pressure and contact from the occupant's body by each compartment for a predetermined period of time. When the device is operating automatically, no adjoining active compartments are deflated during the same time period, so that the size of the gap or opening between the compartments is limited. The compartments may deflate in the following order: compartment (1) first; (4) second; (1) third; (5) fourth; and (3) fifth. The activity is then recycled.

An electrical box with relays and a panel board may be provided that contains on-off, automatic and manual controls. The manual controls may comprise individually numbered switches that enable the operator to deflate or inflate any one, or all, of the compartments. Changing from automatic to manual control allows the operator to deflate the necessary compartments, in order to expose the portion of the patient's body that needs treatment. When all of the numbered switches are placed on the inflated setting, the mattress remains inflated, and performs as a conventional mattress.

An elastic bordered sheet is designed for each individual compartment. The sheets may be replaced one at a time. If one of the sheets is soiled, only the soiled sheet is replaced. In the prior art, the patient must be turned or moved from the bed to replace the sheets, but the device allows the nurse or aide to change individual sheets without substantially disturbing the patient.

If the patient requires a bedpan, the operator selects the appropriate compartment or compartments to allow placement of the bedpan as desired. The manual operation of the device allows ease of placement of the bedpan and further allows enemas, and washing, medication and lubrication of the said patient's body.

An air compressor inflates the compartments. Upon deflation, the air is dissipated into the room. This air compressor is controlled by a pressure switch that maintains the air pressure within a specified range.

A solenoid valve may be installed in the inlet line to each compartment, and another solenoid may be installed in the outlet line. When the inlet solenoid is energized, and open, the outlet solenoid valve is de-energized, and closed. When the inlet solenoid is closed, the outlet solenoid is open. A single pole, double throw relay may be used to transfer electrical power from one solenoid valve to the other. This structure makes it impossible to energize both coils simultaneously.

In hospitals, air pressure is normally available from a central source, eliminating the need of individual air compressors for each device. Each room may be provided with a pressure regulator and a quick connect line that is attached to the device. This supply system is similar to the oxygen lines that are in use now in most hospitals.

It is preferred that foam rubber wedges are used as means to turn the patient with the use of the inflatable compartments. Typical shapes for these triangles or wedges are shown in FIG. 5. The shape may vary according to intended use, as shown. The operator can deflate the compartments one or two a time, then place a wedge in the hollow space. When the compartment is inflated again, it lifts the wedge to turn the patient. In order to turn the patient to the opposite side, the wedges are inserted in the hollow space on the opposite side of the bed. The patient is progressively turned by the mattress and the wedges to a comfortable position. As many as nine of the wedges can be used.

An embodiment of the device uses nitrogen, with a pressure regulator that is attached to an outlet of a nitrogen bottle. This embodiment uses manually operated valves to control inflation and deflation of the compartments. Nitrogen may be used in an emergency, or on a permanent basis, to replace the air compressor.

Another embodiment uses a water to air heat pump unit that heats and cools the water, and is particularly suited for emergency or intensive care use, in addition to other applications. Quick connect water attachments enable the heat pump to be connected quickly to the device. This device may be plugged into any wall receptacle and thermostatically controlled, for example, from 35° F. to 120° F.

DESCRIPTION OF THE PREFERRED EMBODIMENTS

Figure 1:
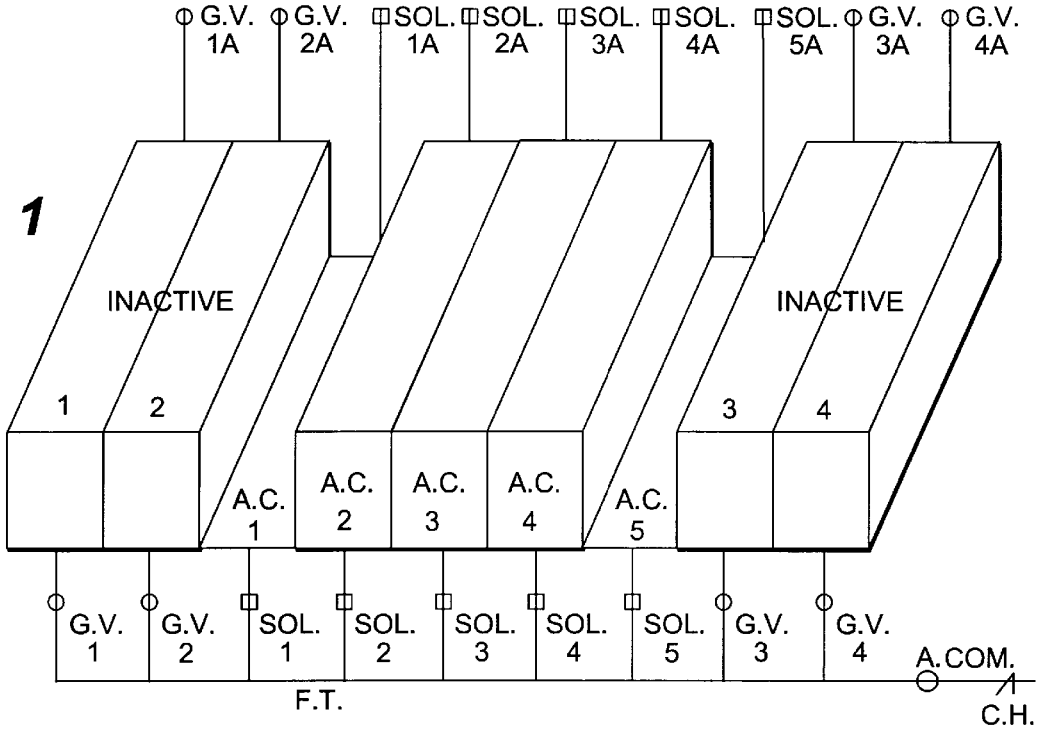
FIG. 1 is a schematic diagram of the device with arrows indicating the flow of air into, and out of, each compartment.

In FIG. 1, the device is described beginning at the discharge line of the air towards the individual air compartments A.C.

The four inactive compartments are inflated and isolated by inlet and outlet globe valves (G.V.) that are shown as closed in FIG. 1. Active compartment 1 (A.C.1.) is deflated, and solenoid valve 1 (Sol. 1) is de-energized and closed, while solenoid valve 1A (Sol. 1A) is energized and opened, allowing air from active compartment (A.C.1) to be dissipated into the room.

Active compartment 2 (AC.2) is inflated and solenoid valve 2 (Sol. 2) is energized and open. Solenoid valve 2A (Sol. 2A) is de-energized and closed.

Whenever any one of the inlet solenoid valves is energized and closed, the outlet solenoid valve is de-energized and open to deflate the compartment.

Compartments A.C.3–A.C. 4 are inflated and controlled in the same manner as active compartment 1, when both are in the same mode.

An electrical box with controlling relays and a panel board with on-off, auto and manual switches is used. Individually designated switches are displayed that enable the operator to deflate or inflate any one, or all, of the compartments.

The automatic mode controls the air mattress and has nine compartments in the preferred embodiment. Two compartments are located on each end and are inactive, and the remaining five are active. When any one of the active compartments is deflated, the remaining four are inflated.

This action is time controlled allowing each of the active compartments to deflate, and to remove contact and pressure with the patient's body. In the automatic mode, pressure and contact is removed from the patient's body for a predetermined period of time such as twelve minutes in each hour. When the system is operating in this programmed mode, no two adjoining compartments are deflated, which limits the size of the opening that the patient's body must bridge. The compartments may deflate in the following order: compartment A.C. 1 is first, A.C. 4 is second; A.C. 2 is third, A.C. 5 is fourth and A.C. 3 is fifth. The device continues in this cycle.

The setting of the switch from automatic to manual control allows the operator to deflate or inflate the necessary compartments in order to expose the portion of the patient's body that requires treatment. Manual control of the compartments allows the operator access to portions of the patient's body as necessary. When all switches are placed on the inflated setting, all compartments are inflated and the mattress and performs as a conventional mattress.

The air compressor (A. COM.) supplies air to inflate the compartments. Upon deflation, the air is discharged into the room. The air compressor is actuated by a pressure switch that keeps the air pressure within a predetermined range.

Figure 4:
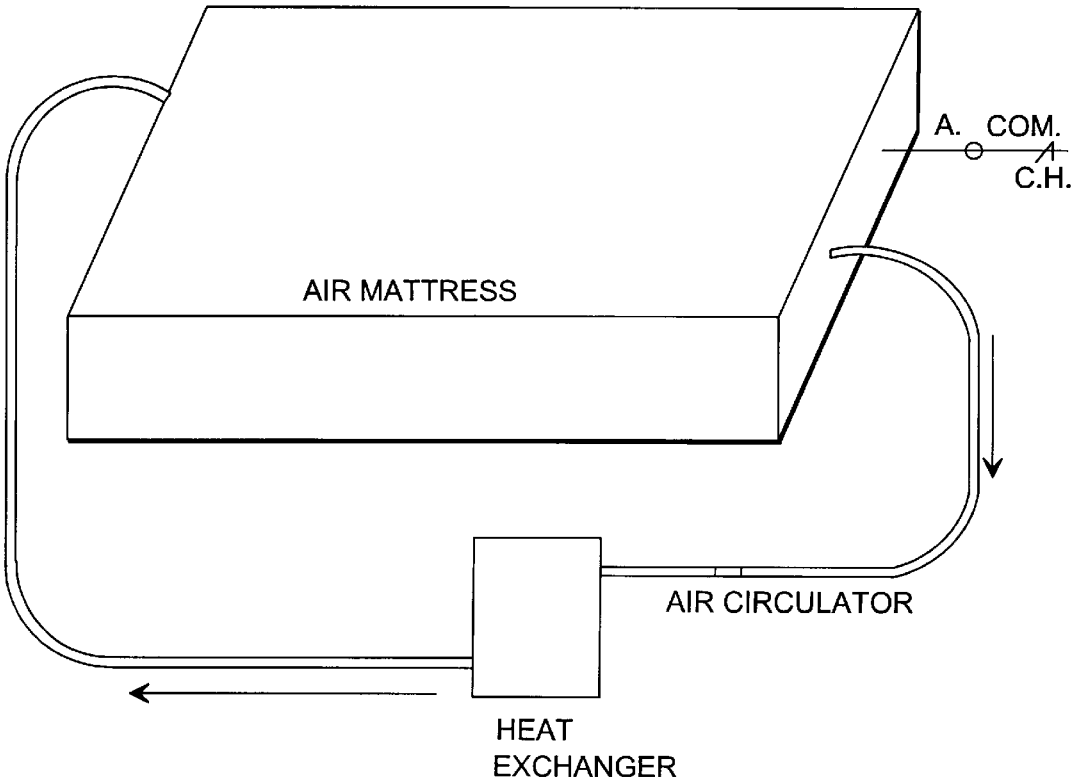
FIG. 4 and the details show an embodiment of the device with air ducts and an air to air heat pump.
Figure 4A:
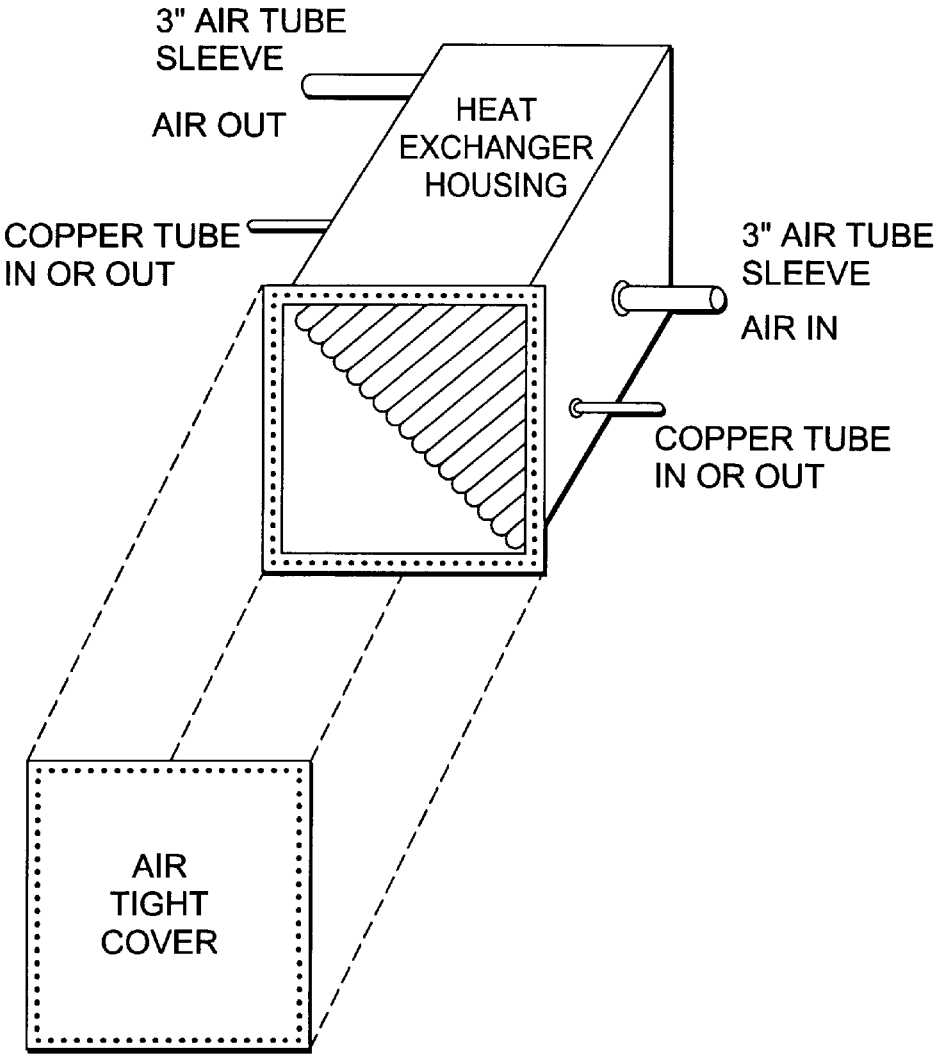
Figure 4B:
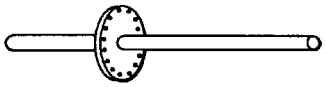
Figure 5:
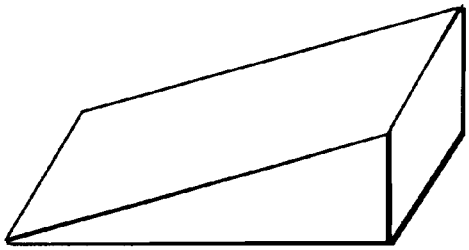
FIG. 5 show the embodiments of the wedges.
Figure 5:
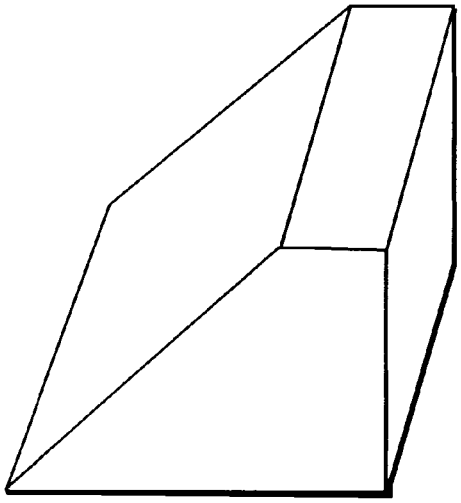
Figure 5:
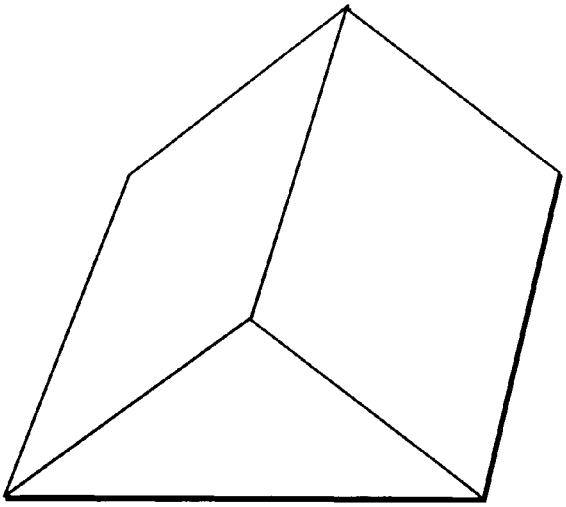

In the preferred embodiment, nine triangular foam rubber turning wedges are used to turn and hold the patient on his or her side. FIG. 4—DETAIL—TWO. A wedge is placed in the hollow space of the deflated compartments 1 and 5. When the operator places the numbered switches that control active compartment 1 and active compartment 5 on the inflated position, the air compressor will fill these compartments with air, forcing the wedges upwardly to begin turning the patient. The operator sets the numbered switches to cause compartments 1 and 4 to deflate, then places wedges in the hollow spaces. The compartments are inflated, and two turning edges rise to lift and support the turning of the patient. At this point, active compartment 3 is deflated and another wedge is placed in the hollow space. When inflated, active compartment 3 adds additional support to the patient's body. The four inactive compartments are controlled by their globe valve, and the turning wedges may be used to give additional support to the patient. In order to turn the patient to the other side, the wedges are inserted from the opposite side of the bed using the same method.

The invention may be used to:

(1) raise the patient to a television viewing or reading position by deflating inactive compartment 2 and active compartment 1. To deflate inactive compartment 1, close globe valve (G.V.) 2 and open globe valve 2A to allow the air to escape. The active compartment 1 in FIG. 1 is shown as deflated, allowing a body lifting edge to be placed in the hollow space. Globe valve 2A may be closed and globe valve 2 opened, and the switch for active compartment 1 placed in the inflate position to lift the patient and support him in a comfortable television viewing position.

(2) position the patient from the television viewing position described in (1) above to a full sitting position by pulling the patient forward and placing two turning wedges behind his back and head to support him comfortably while eating, drinking, reading or writing.

(3) lift the occupant's legs, by means of a wedge placed in the appropriate two deflated compartment spaces, then inflating, to raise and support the legs in a triangular position.

(4) turn the patient's body to the side.

(5) cyclically remove portions of the patient's body from contact with the bed.

The device may be used in hospitals and other convalescent or health care facilities, or in the home. The device eliminates substantial labor needed in health care situations.

Figure 2:
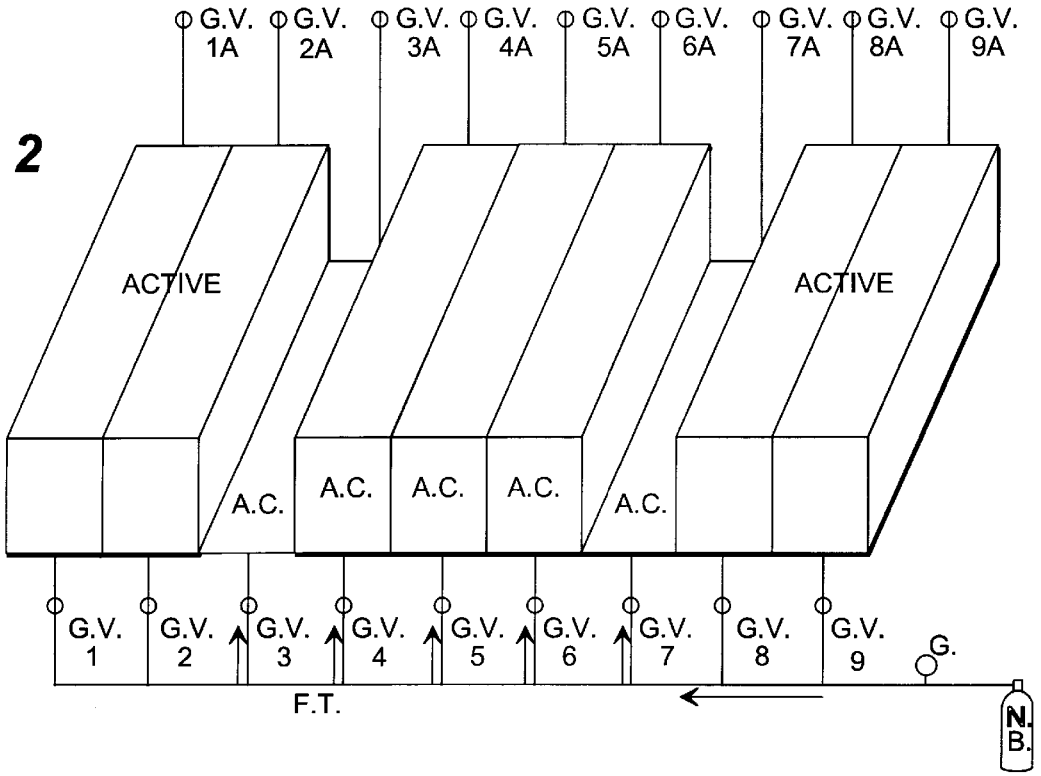
FIG. 2 is a schematic diagram of an additional embodiment of the device with arrows indicating the flow of nitrogen from a bottle and through the device.

FIG. 2 shows a manual embodiment using nitrogen inflation, controlled by a sequence of globe valves. One globe valve is located at inlet and another at the outlet of each of the gas filled compartments. The inflating and deflating of each aid compartment is selectively controlled by the operator.

The nitrogen pressure in the gas filled compartments is controlled by a pressure regulator valve located at the outlet of the nitrogen bottle. If pressurized air is available, then the pressurized air may replace the nitrogen.

The operator deflates or inflates any of the compartments by opening or closing of the globe valves. The wedges are used in the same manner as set forth herein.

Figure 3:
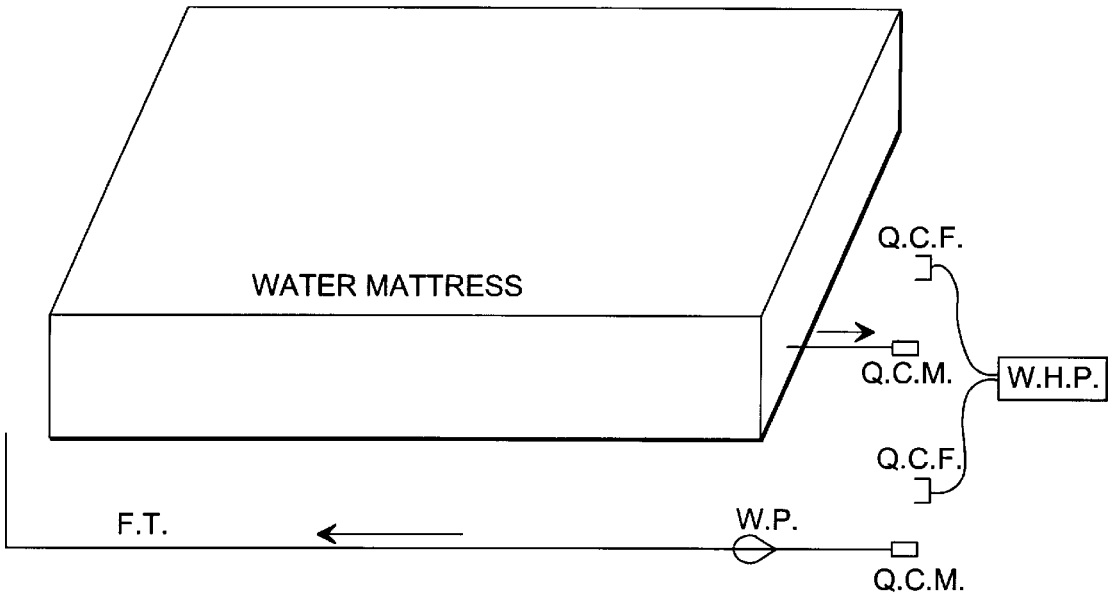
FIG. 3 is a schematic diagram of another embodiment of the device having a water to air heat pump with a circulating water pump.

FIG. 3 shows an embodiment that uses a water to air heat pump that heats or cools water in the mattress. Quick connect water attachments with a water pump enables the heat pump to be connected quickly to the mattress. This device may be plugged into any wall receptacle and may be thermostatically controlled. Typically, the device will be controlled within a range of 35° F. to 120° F.

The embodiment shown in FIG. 4 performs in the same manner as the embodiment of FIG. 3. FIG. 4 and details show the individual parts, one of which is the mattress with an air circulator that is installed within the closed air system.

The heat exchanger housing demonstrates how the air flows over the slant coil to heat or cool the air. The heat exchanger is a part of the heat pump air to air system that is capable of cooling or heating the air as controlled by a thermostat.

In the heating cycle, the slant coil operates as a condenser and heats the air as it passes over its coils. In the cooling cycle the slant coil operates as an evaporator and removes the heat from the air passing through the coil to cool the air in the mattress. An air tight cover with gasket is attached to the heat exchange housing.

Copper tubes with flanges allow the tubing from the heat exchanger to leave the housing without the loss of air. The copper tubing is attached, such as by soldering, to the flange and is bolted and sealed to the heat exchange housing in an air tight fashion. The flexible air tubes are attached to the housing and to the mattress by sleeves and clamps. This air filled mattress is used with an air-to-air heat pump that controls the air temperature.

An air compressor that is pressure controlled keeps the mattress inflated. A check valve is used to keep the air from leaking back into the atmosphere in the off cycle. This check valve is directional, and allows the air to enter the compressor when it is in operation. When the required pressure is satisfied, the air compressor is not in motion, and the check valve seals and prevents the air from escaping.

An air circulator pulls air through flexible tubing from the air mattress and the air is circulated into the heat exchanger housing. FIG. 4. The air is then moved over the slant coil heat exchanger, which heats or cools the air, depending on the setting of the thermostat. The air is then pushed from the heat exchanger housing through the flexible tubing back into the mattress to complete the air cycle. A thermostat located in the return air section of the housing controls the air temperature in the mattress. A relatively low horsepower self contained heat pump unit is used to heat or cool and maintain the temperature. This embodiment with temperature control may be used with a central air pressure system, self contained air compressor, or bottled nitrogen.

The device may be used in the home, and will save large amounts of electricity. In a three bedroom home, three of these mattresses would typically consume ⅜ horsepower, while a central heating system uses three or more horsepower. At night, the mattress keeps the occupant comfortable while the central air conditioning system may be set thermostatically to be warmer in the summer and colder in the winter.

What is claimed is:

1. A multiple compartment inflatable mattress, comprising:

a. a multiplicity of compartments, with each of said multiplicity of compartments located adjacent to at least one other of said multiplicity of compartments, wherein each of said multiplicity of compartments is selectively inflatable and deflatable;

b. an inflation device which is connected to said multiplicity of compartments and provides a gas under pressure to said multiplicity of compartments for selectively inflating and deflating said each of said multiplicity of compartments; and c. at least one longitudinal turning member which is inserted over at least one of said multiplicity of compartments and is positioned between compartments which adjoin said at least one of said multiplicity of compartments on either side thereof when said at least one of said multiplicity of compartments is deflated, and said at least one longitudinal turning member is positioned above said at least one of said multiplicity of compartments when said at least one of said multiplicity of compartments is in an inflated state.

2. A multiple compartment inflatable mattress as described in claim 1, further comprising a closed loop gas recirculation device which is connected to said multiplicity of compartments, and a heat exchanger which communicates with said closed loop gas recirculation device and exchanges heat with said gas.

3. A multiple compartment inflatable mattress as described in claim 1, wherein said gas is nitrogen.

4. A multiple compartment inflatable mattress as described in claim 1, wherein said gas is supplied from a portable bottle having at least one pressure regulator attached thereto.

5. A multiple compartment inflatable mattress as described in claim 1, wherein said at least one longitudinal turning member is wedge shaped.

6. A multiple compartment inflatable mattress, comprising:

a. a multiplicity of compartments, with each of said multiplicity of compartments located adjacent to at least one other of said multiplicity of compartments, wherein each of said multiplicity of compartments is selectively inflatable and deflatable, and wherein at least one of said multiplicity of compartments extends longitudinally to an outside edge of the mattress, and upon deflation of said at least one of said multiplicity of compartments, said at least one of said multiplicity of compartments forms an opening at said outside edge of the mattress between compartments which adjoin said at least one of said multiplicity of compartments on either side thereof;

b. an inflation device which is connected to said multiplicity of compartments and which provides a gas under pressure to said multiplicity of compartments for selectively inflating and deflating said each of said multiplicity of compartments; and c. at least one longitudinal turning member which is inserted over said at least one of said multiplicity of compartments at said opening at said outside edge of said mattress and is positioned between compartments which adjoin said at least one of said multiplicity of compartments on either side thereof when said at least one of said multiplicity of compartments is deflated.

7. A multiple compartment inflatable mattress as described in claim 6, further comprising a closed loop gas recirculation device which is connected to said multiplicity of compartments, and a heat exchanger which communicates with said closed loop gas recirculation device and exchanges heat with said gas.

8. A multiple compartment inflatable mattress as described in claim 6, wherein said gas is nitrogen.

9. A multiple compartment inflatable mattress as described in claim 6, wherein said gas is supplied from a portable bottle having at least one pressure regulator attached thereto.

10. A multiple compartment inflatable mattress as described in claim 6, wherein said at least one longitudinal turning member is wedge shaped.

* * * * *